US005890741A

United States Patent [19]

Hollander

[11] Patent Number: 5,890,741

[45] Date of Patent: Apr. 6, 1999

[54] ENTERTAINMENT AND EDUCATIONAL CARD, AND PACK THEREOF, AND METHOD OF MANUFACTURING SAID CARD

[75] Inventor: Milton Bernard Hollander, Stamford, Conn.

[73] Assignee: Omega Engineering, Inc., Stamford, Conn.

[21] Appl. No.: 740,604

[22] Filed: Oct. 31, 1996

[51] Int. Cl.[6] ..... B42D 15/00

[52] U.S. Cl. ..... 283/62; 285/61; 285/56; 281/2; 281/5

[58] Field of Search ..... 283/117, 61, 62, 283/56; 281/2, 5; 40/124.11, 124.13; 273/296, 293; 434/172; D21/42, 44

[56] References Cited

U.S. PATENT DOCUMENTS 354,424 12/1886 Kirk ..... 273/296

5,261,703 11/1993 Lenkoff ..... 283/117

FOREIGN PATENT DOCUMENTS 2252655 8/1992 United Kingdom ..... 434/172

*Primary Examiner*—Willmon Fridie, Jr.
*Attorney, Agent, or Firm*—William A. Drucker

[57] ABSTRACT

The invention provides an elongate folded card, for example of the same size as a mailable postcard when fully folded, which bears on one of its faces when fully folded a display of an entertainment nature such as a representation of playing pieces of a game, or one of a series of collectable items such as famous footballers, or a panel of a cartoon strip, whereas on its other face or faces there is provided a display of material having an educational aspect, for example commercial subject matter. In a first preferred form, the card, when fully folded, has the dimensions of a playing card so as to permit formation of a 'pack' of playing cards. In another preferred form, the card when fully folded has the shape and dimensions of a mailable postcard, so as to permit formation of a mailable pack of cards of postcard size.

2 Claims, 3 Drawing Sheets

ENTERTAINMENT AND EDUCATIONAL CARD, AND PACK THEREOF, AND METHOD OF MANUFACTURING SAID CARD

This disclosure contains no right to any invention made under federally-sponsored research and development.

BACKGROUND OF THE INVENTION

Field of the Invention

This invention relates generally to products of an entertainment and educational nature, and more specifically relates to cards which can be readily varied, as by a folding and unfolding action, so as to present selectively an entertainment aspect and an educational aspect at the will of the user.

OBJECTS OF THE INVENTION

An object of the invention is to permit a card, for example of comparable dimensions to a known playing card, or a known postal card, to have a dual purpose of being both adapted to have an entertainment aspect, e.g. to permit use in playing a card or other game, or to permit the forming of collections of popular subjects, or a serial display such as a cartoon strip, and also adapted to have an educational aspect, e.g. to permit display of useful information such as commercial information, or educational facts or formulae. Game rules or a score card may be on one surface.

Another object is to provide an article of manufacture in stackable form suitable for postal distribution.

A further objective is to provide a device arranged to permit tear off parts to be separated by a user for mailing or games or collecting.

A still further object is to provide a method of manufacturing such cards.

SUMMARY OF THE INVENTION

According to the invention there is provided a rectangular card which comprises a sheet of still material having a portion with a hinge action defining in the sheet, preferably along the shorter dimension, a plurality of plane leaves, the hinge and leaves being such that when adjacent leaves are folded about the hinge they become superposed in corresponding position, one face of each leaf, when the card is fully folded, bearing representational matter of entertainment value to a user, and the other face of each leaf, when the card is fully folded, bearing representational matter which is of educational value to the user.

BRIEF DESCRIPTION OF THE DRAWINGS

The above-mentioned and other and further objects, features and advantages of this invention will be made apparent to those having skill in this art, by the following specification considered with reference to the accompanying drawings, in which.

DETAILED DESCRIPTION OF THE INVENTION

Figure 1:
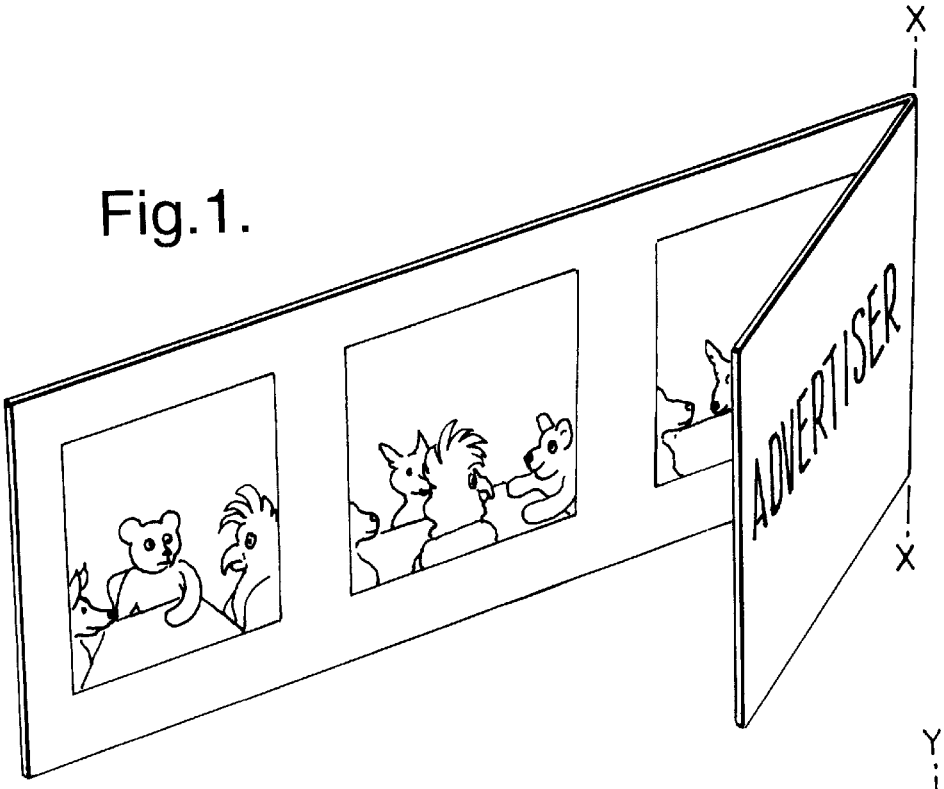
FIG. 1 shows the two faces of an elongate card folded at a transverse line X—X.

Referring to FIG. 1, there are shown the two faces of an elongate card which is adapted to be folded about a transverse line X—X. One face of the card has entertainment material, represented say by the cartoon figures shown. The other face of the card has educational or instructive material, represented for example by pictures of items of electronic apparatus, to which suitable explanatory wording would be added in practice, and details of an advertiser. When the card is in fully folded condition, the two leaves, at each side of the fold line X—X, are superposed. Preferably, the card when folded, or at least one leaf, has dimensions which correspond to, for example, a standard playing card, or to a mailable postcard. This is an elongated rectangular shape.

Figure 2:
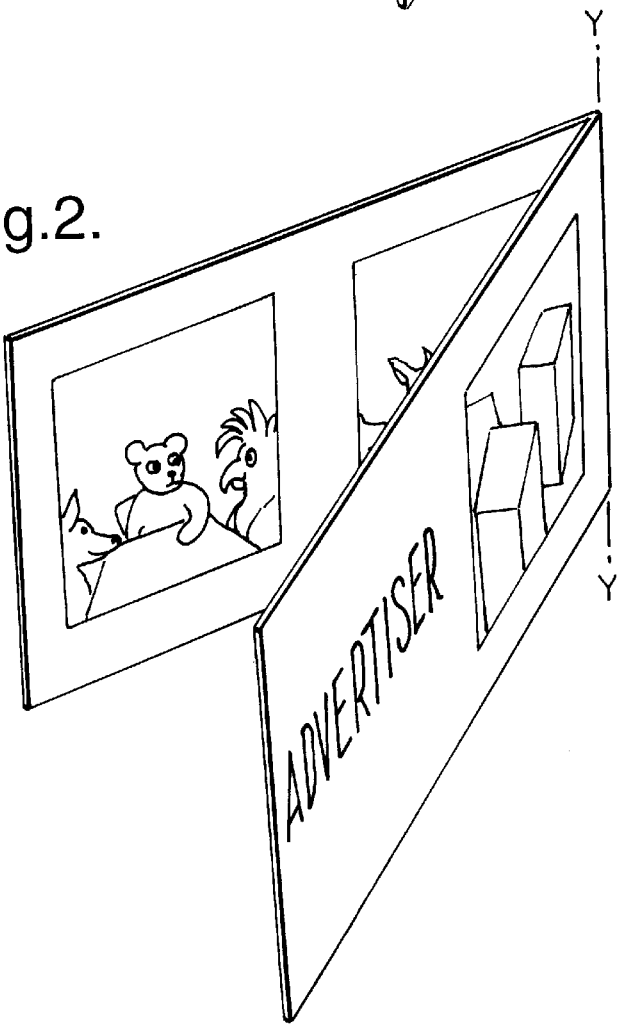
FIG. 2 shows the two faces of an elongate card folded at a transverse line Y—Y.

FIG. 2 shows a similar card in which the transverse fold line Y—Y is central along the length of the card, the two faces having similar subject matter as in FIG. 1.

Figure 3:
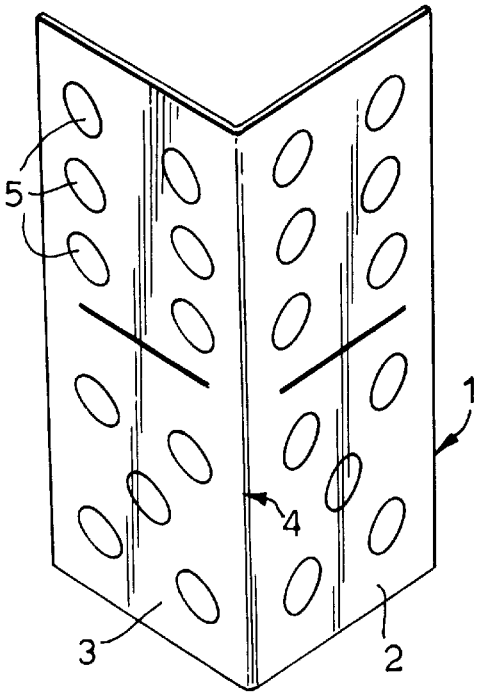
FIG. 3 is a perspective elevation of a single-fold card to show external surfaces bearing subject matter.
Figure 4:
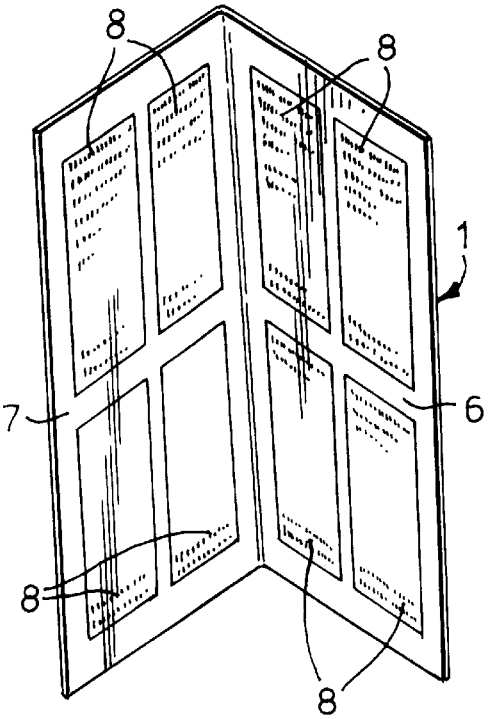
FIG. 4 is a perspective elevation of the foldable card of FIG. 3 to show internal surfaces bearing subject matter.

Referring now more specifically to FIGS. 3 and 4 of the drawing, there is shown a single-fold card designated generally by reference numeral 1. The card 1 has two leaves, 2 and 3 meeting at a hinge line 4, at least one of the leaves 2 and 3 being of standard mailable postcard dimensions.

The card 1 may be made of any suitable sheet material which is adequately stiff but foldable at the hinge line 4, and may be a single sheet or a laminated sheet. Parts maybe separable by tearing at the hinge, or at other locations, for remailing or game playing.

On the outer face of each leaf 2 and 3 there are provided markings 5 suitable for permitting the cards to be used in, for example, playing a game, or a strip cartoon, or to form a collection of useful knowledge such as pictures of football players, or 'flags of all nations', or coats-of-arms, or any other kind of subject matter which can readily be formed into a series which is of interest. In the example illustrated, which is purely by way of illustration, the card has one of the conventional pairs of sets of 'spots' which appear on the playing pieces of the game of dominoes. It is envisaged that there would be provided, in a pack referred to later therein, a sufficient number of the cards to enable a game to be played or a set of interesting features acquired.

Referring now to FIG. 4, there is seen the same card as in FIG. 3, but with the faces 6 and 7 revealed, these faces being those which become internal faces when the card is fully folded. On the faces 6 and 7, there is provided other subject matter contained in a plurality of printed panels 8, and it will be seen that when the card is in the fully folded state, the printed panels 8 will all be on the 'inside' of the card. The panels 8 bear educational and/or informative material, such as for example, items of history or geography, or details of new commercial products, or technical advances in any scientific art. Where a game is on the outer face, the rules may be on an inner face, and/or a score sheet may be provided.

It will be seen that, when the individual cards of an entire set of such cards are all in the fully folded condition, the cards can be used to play a game or reveal a cartoon strip, or show football teams or display collections of educational items, as the case may be.

Figure 5:
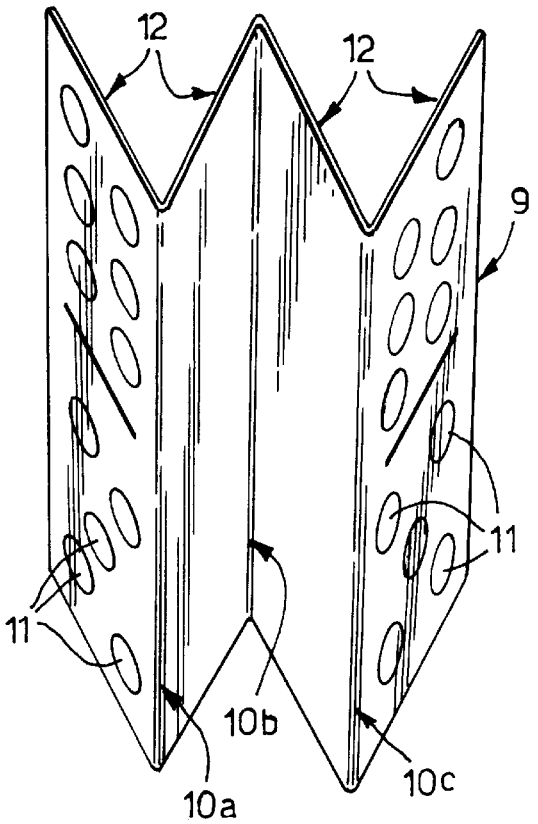
FIG. 5 is a perspective elevation of a multiple-fold card to show external surfaces bearing subject matter.

Referring now to FIG. 5 there is shown a perspective elevation of a second form of foldable card 9 in which there are provided three folds 10*a,* 10*b* and 10*c* which result in the formation of four identical 'outer' faces 11. It will be apparent, without the need for illustration, that the card will likewise have a total of four 'inner' faces similar to the face 6 of FIGS. 3 and 4. On those two 'outer' faces 11 which appear when the card is fully folded, there are marked the indications such as those referred to in the description of FIGS. 3 and 4, e.g. the 'spots' of a representative playing piece of a game of dominoes. The material marked on such outer faces may be any as referred to herein with reference to FIGS. 3 and 4.

On each of the four correspondingly-formed 'inner' faces 12, which are not visible in this Figure of the drawing, but which would correspond to the 'inner' faces 6 and 7 of FIGS. 3 and 4, there are provided similar panels of educational and/or informative material.

It is to be noted that, whereas in FIGS. 1 and 2 the entertainment subject matter is on inner faces of the cards, in FIGS. 3, 4 and 5 the entertainment subject matter is on outer faces of the cards.

A set of a plurality of such cards 9, when all of the cards are in fully folded condition, can be used to play a game or any of the other functions described above with reference to FIGS. 3 and 4.

Figure 6:
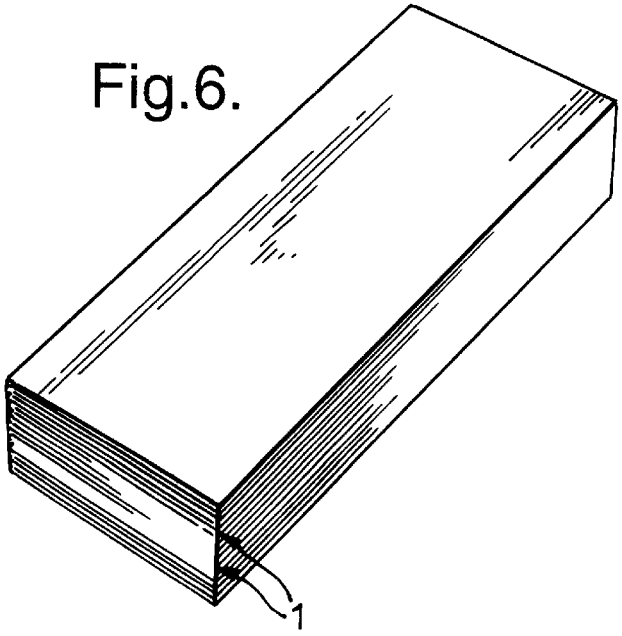
FIG. 6 is a perspective elevation of a mailable pack of any of the foldable cards of this invention, with the respective cards all being in fully folded condition in the pack.

Referring now to FIG. 6, there is seen a plurality of the cards of FIGS. 1 to 5, arranged as a pack which can be handled in the same manner as a conventional pack of playing or postal cards. Thus in accordance with this invention, there is further provided a pack of cards having a dual function of providing a readily accessible store of 'interest' material which can be used to play a game, form a collection or the like, and also another readily accessible store of educational and/or informative material, particularly for commercial purposes.

Figure 7:
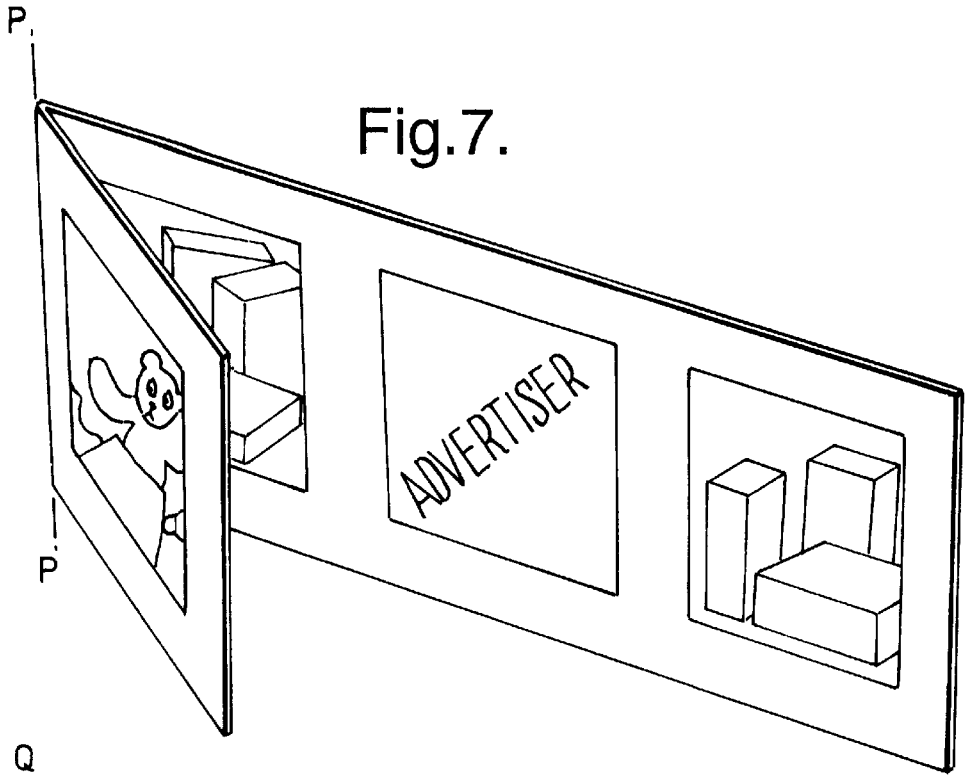
FIG. 7 shows the two faces of an elongate card folded at a transverse line P—P.

Referring now to FIG. 7, there is seen an elongate card which is folded about a transverse fold line P—P, but wherein the entertainment material, represented say by the cartoon figures shown, is on the outer faces of the folded card, i.e. also on the rear face of the longer portion of the card, not visible in this Figure. On the inner face of the two leaves of the card there is provided educational, instructive and/or commercial material, as seen on the longer lead, and this material would appear also on the inner face of the shorter leaf, but is not visible in this drawing.

Figure 8:
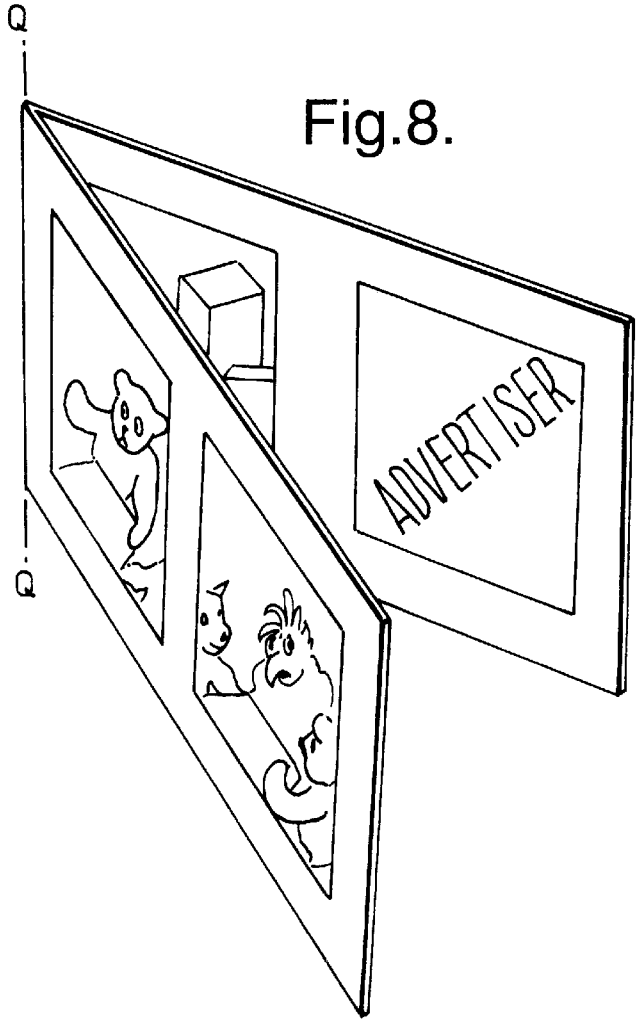
FIG. 8 shows the two faces of an elongate card folded at a transverse line Q—Q.

Referring to FIG. 8, there is seen an elongate card which is folded about a transverse fold line Q—Q, but wherein the entertainment material is similarly on the outer faces of the folded card, whereas on the inner faces there is similarly provided educational, instructive and/or commercial material.

It is to be noted that the cards of FIGS. 1 and 2, and 7 and 8, have their fold transverse to the longer dimension of the card, whereas the cards of FIGS. 3–4, and 5, have their fold along the longer dimension.

Although not limited to such dimensions, it is advantageous if the size of the longest part of the card, when full folded, is that of a mailable postcard, such that the pack of FIG. 6 would be a mailable pack.

The educational and/or informative material has been shown in the drawings as distributed in a number of panels on a face of the card, but clearly it may be arranged in any convenient disposition on the face.

It will be apparent that the number of panels could be, for example, from three to eight, and a preferred number of panels is four.

The user may tear off one leaf, to be used for example in a game, and put the other leaf in the mail as a postcard. The pack of cards would usually, but not necessarily, consist of a plurality of cards all or some of which are different form the others.

In the drawings there have been shown cards with a single fold, and with three folds. There could, for example, be provided without limitation thereto a number of folds like the single fold as illustrated in FIGS. 3 and 4. The fold line may be central or offset from the centre to provide a short arm and also to provide a long arm of postcard size. The card may be supplied unfolded but with a pre-fold or scored tear line.

The use of the term 'plane' to describe the sheet material does not preclude the use of embossing, addition of one or more overlying portions of material, or perforation, or any combination of these functions.

The term "fold" used herein may include a perforation or scored or impressed line.

Although various specific embodiments of the invention have been described and illustrated herein, it will be obvious to those having skill in this art that various other fully equivalent embodiments consistent with the invention are possible and evident within the scope of this disclosure.

I claim:

1. An entertainment and educational card comprising an elongate sheet of stiff material having hinge means across a shorter transverse dimension of said card and defining therein a plurality of plane leaves, of which the shape and dimensions of at least one leaf correspond to those of a mailable postcard; and wherein when adjacent leaves are folded about said hinge means, they become superposed in corresponding position, one face of each leaf when the card is fully folded bearing a representation of entertainment value to a user, arranged in a plurality of panels, and the other face of each leaf when the card is fully folded bearing a representation of educational value to a user; the hinge being located off the center of the longer transverse dimension.

2. A plurality of entertainment and educational cards claimed in claim 1, said cards being individually dissimilar in content, said cards being all of the same overall postcard dimensions to form a mailable pack of cards.

* * * * *